US005694695A

United States Patent [19]

Lund

[11] Patent Number: 5,694,695

[45] Date of Patent: Dec. 9, 1997

[54] COUPLER SYSTEM FOR TELESCOPING POLES

[76] Inventor: Allen E. Lund, 3100 Lincoln Way, Costa Mesa, Calif. 92626

[21] Appl. No.: 641,329

[22] Filed: Apr. 30, 1996

[51] Int. Cl.[6] ..... B26B 27/00

[52] U.S. Cl. ..... 30/296.1; 30/166.3; 15/144.4; 403/351; 403/109

[58] Field of Search ..... 30/298, 249, 166.3, 30/514, 517, 296.1; 403/109, 350, 351; 15/144.4; 16/115

[56] References Cited

U.S. PATENT DOCUMENTS

| | | | |
|---|---|---|---|
| 2,546,157 | 3/1951 | Hume | 403/351 |
| 3,596,946 | 8/1971 | Burton et al. | 15/144.4 |
| 3,825,359 | 7/1974 | Fulton | 403/350 |
| 3,942,826 | 3/1976 | Lester | 403/250 |
| 4,653,142 | 3/1987 | Upton | 15/144.4 |
| 4,976,031 | 12/1990 | Miller | 30/166.3 |
| 5,417,511 | 5/1995 | Warden | 403/350 |

*Primary Examiner*—Hwei-Siu Payer
*Attorney, Agent, or Firm*—Price, Gess & Ubell

[57] ABSTRACT

A telescoping pole assembly is disclosed featuring an eccentric collar and collet which is used to frictionally lock an inner pole which slides within an outer pole. The locking mechanism of the present invention is especially suitable for fiberglass and plastic poles which tend to slip or fracture upon concentric loading as is used in the locking mechanisms of the prior art. The eccentric collet and collar cooperate to form a pathway for the inner sliding pole when the collet is aligned in the open position, and the collet and the outer pole trap the inner pole due to the eccentricities of the collet and the annular collar, which causes a misalignment of the pathway when the collet is rotated into a locked position. The telescoping pole assembly of the present invention is especially suited for tree trimming equipment because the locking assembly does not inadvertently unlock when a torque is applied to the poles, as might be the case when a user attempts to cut a tree branch by twisting the cutting blade.

6 Claims, 2 Drawing Sheets

FIG. 5
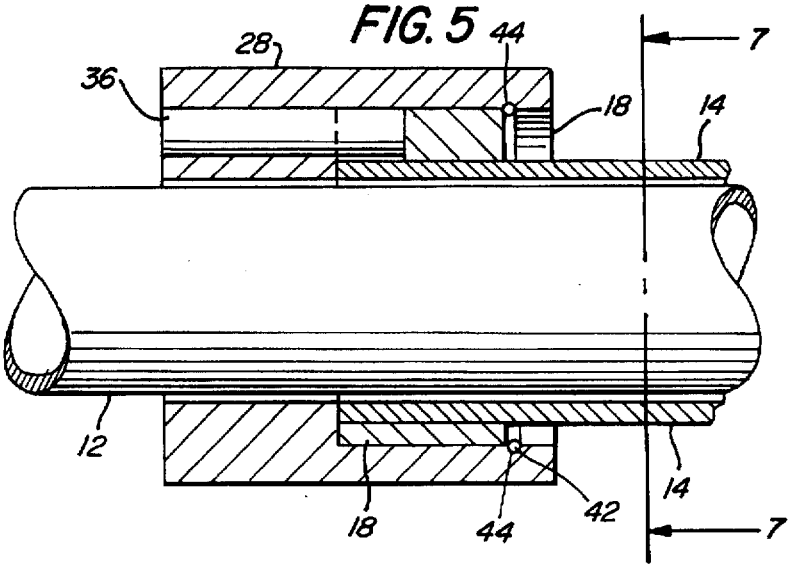
FIG. 6
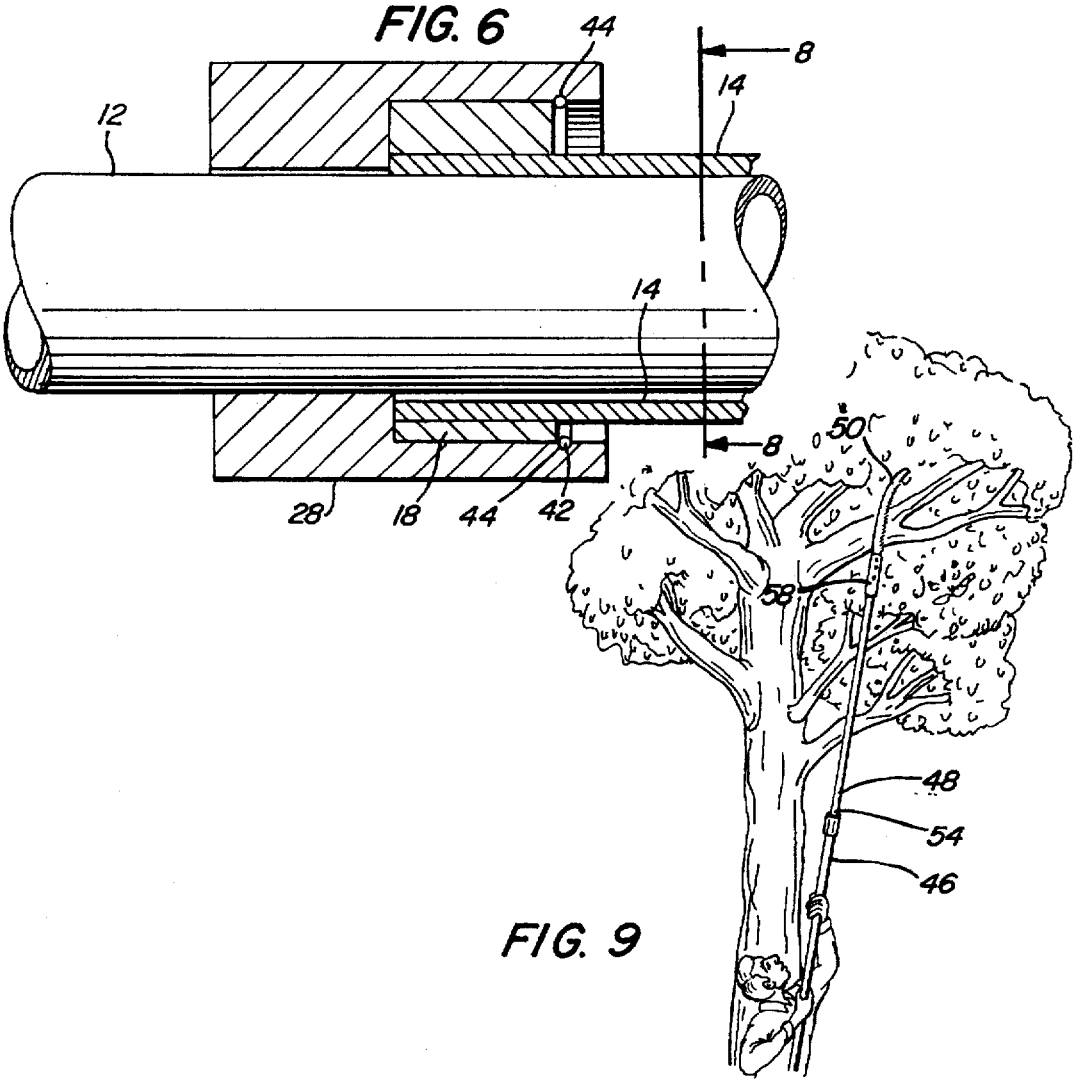
FIG. 9

COUPLER SYSTEM FOR TELESCOPING POLES

BACKGROUND OF THE INVENTION

1. Field of the Invention

The present invention relates to tool extensions and, more particularly, to a telescoping pole assembly and coupler system for telescoping poles for use in tree trimming, window washing, pool cleaning, surveying markers, flag poles, and the like.

2. Description of Related Art

Telescoping poles are well known in the art and have been used for a great number of applications. Window washers use telescoping poles to wash windows that are beyond the practical reach of single poles, and pool cleaners use telescoping poles to reach otherwise inaccessible bottoms of pools without having to enter the pool. Another important application of telescoping poles is tree trimming equipment, which allows the user to reach and trim areas of a tree that would otherwise be inaccessible. In tree trimming applications, a cutting blade is typically fixed at the end of the upper pole, with a rope or cable leading down to the bottom pole to a mechanism which can be operated by the user. The mechanism can then be used to manipulate the cutting blade such that when a branch is positioned between the cutting blade and a fixed plate opposed the blade, the mechanism is activated, causing the blade to cut the branch. Alternatively, a saw blade can be attached to the pole for sawing distant branches.

Telescoping poles are prominent in the fields identified above and operate on a simple basis where an inner pole is disposed within a larger (diameter) outer pole and gradually extended until the combined length is the desired length. Telescoping poles conserve space in that a series of poles may be used to telescope to a great distance and obviates the need for unwieldy and cumbersome longer poles. The essence of telescoping poles is the ability to lock an inner pole within the outer pole once the desired length is achieved where said coupling is quick and reliable. In most applications, due to the nature of the type of work performed with telescoping poles, if a pole becomes inadvertently unlocked then the user may be considerably delayed or the pole may in some instance be lost. For example, if a pool cleaner suddenly finds the extending half of his pole assembly has become uncoupled, the tool end of the assembly may sink to the bottom of the pool. Similarly, tree trimmers may find that their cutting tool has become dislodged from the base pole and is now dangling from a tree limb. As can be seen, telescoping poles require a reliable method of locking and unlocking the poles which is not prone to inadvertent uncoupling.

Telescoping poles of the prior art typically use either a threaded concentric locking ring that fits over the two poles and tightens around the two poles as it is screwed onto the outer pole, or an inner locking cam mechanism. In the former, the outer pole often includes cutaway slits longitudinally at the end to form fingers, which enables the locking ring to readily constrict and compress against the inner pole. In this manner, the inner pole is radially compressed concentrically from the outer pole due to the compressive force of the locking ring as it constricts the two poles. To unlock the assembly of this configuration, the locking ring is rotated in the opposite direction while one of the poles is held in place. If the locking ring is tightened sufficiently, this method can satisfactorily secure the two poles under some circumstances, but has proved quite unsatisfactory in other situations. Specifically, this coupling system of the prior art has led to some problems when the tools are in use and a twisting or pulling force is applied to the tool. Under these conditions, it is not unusual for a telescoping pole to be inadvertently unlocked when a user twists or pulls on the tool, which as previously mentioned may result in the loss of the tool or at least significant cost of time and effort to retrieve a tool that has become disengaged. For example, a tree trimming saw of the prior art is often used to trim branches of trees that may be up to 30 feet above the ground. Often the branches are too tough to merely cut through without some hacking or twisting of the tool, or the tool may be caught on some branches which requires some twisting to dislodge the tool. This twisting causes a torque to be applied to the telescoping pole which, in turn, can cause the poles to inadvertently unlock. The torquing of the telescoping poles causes the locking ring to unlock in some circumstances because the same force is required to intentionally unlock the mechanism. The result is that the upper pole may become stuck on the branch or other limb with no way to retrieve it, since the two poles have lost the locking connection. The same situation can occur in a pool where the length of the poles increases the likelihood that a torque will cause the mechanism to unlock, and the extending pole may catch on a drain or simply fall into the pool. This is a result of the increased amount of torque necessary for a longer pole to apply the same force as a shorter pole. As the length of the telescoping pole increases, more torque is required to apply a force on the tool end of the apparatus. This increased torque is often more than the torque necessary to unlock the mechanism of the prior art, causing inadvertent unlocking.

Another drawback of the prior art telescoping poles is that the locking mechanisms do not function well with fiberglass poles. The presence of electrical power lines has led the tree trimming industry away from metal poles due to the dangers involved. Fiberglass or plastic poles have become the standard for telescoping poles due to their lightweight nature and cost advantages, in addition to their insulating properties. However, the concentric locking mechanisms of the prior art do not grip the smooth brittle surface of the fiberglass poles well, often leading to cracking, slipping, or chaffing. It is specifically the hard surface of the fiberglass poles now in use in the field that tends to crack or splinter when a constricting force is applied. This limitation has slowed the acceptance of fiberglass poles and created a dilemma that the present invention attempts to solve. The prior art also requires that the inner pole be hollow in order to yield under the concentrically applied force. It may be useful in some situations to employ a solid inner pole, such as when an especially rigid pole is required. Unfortunately, solid inner poles do not compress enough to lock under the concentric pressure of the prior art.

The prior art is still seeking to develop an easy-to-use telescoping pole for tools such as pool cleaning and tree trimming equipment that secures tightly and resists unlocking when a torque is applied to the end of the pole. Furthermore, the need for such an assembly should adapt equally well to fiberglass and metal poles, and should be simple to use and manufacture.

OBJECTS AND SUMMARY OF THE INVENTION

The present invention is directed to a telescoping pole that utilizes a lateral pressure force to lock an extending inner pole within an outer pole, and does not release the inner pole inadvertently when a torque is applied to the attached tool. An object of the present invention is to teach a locking mechanism that can be readily used for fiberglass or plastic poles, including a solid inner pole. Another object of the present invention is to teach a locking mechanism for a telescoping pole assembly that will resist unlocking when a torque or twist is applied to the telescoping poles. Another object of the present invention is to teach a simple locking mechanism for a telescoping pole assembly that can be locked and unlocked quickly and easily, but which locks a pole in place with high reliability. Still another object of the present invention is to produce a tree trimming tool that can quickly and easily extend to desired lengths to access trees and maintain a locked posture even when torquing forces are applied to the tool.

The advantages of the present invention are that it can be used to lock both fiberglass and metal poles quickly, and will resist unlocking inadvertently and prematurely. The present invention uses an eccentric collar on the outer pole and a collet having an eccentric center hole that allows the inner pole to slide freely when the collet is rotated into the open position, but applies a lateral locking force on the inner pole when the collet is rotated about the collar. This is the result of the two eccentricities which, when aligned, provide a clear passage for the inner pole to slide but, when rotated out of alignment, cause the inner pole to be trapped by the collet. As the collet is rotated about the eccentric collar, it deforms slightly as the passage for the inner pole becomes misaligned with the pole itself. The resulting force on the inner pole is not a constricting radial force but rather a lateral friction force, and the rigid surface of the fiberglass pole is frictionally trapped by the misalignment of the two eccentric components. Most important, a torque on the poles does not release the lateral force and does not cause the locking mechanism to unlock and, therefore, the assembly is less likely to inadvertently unlock. In fact, twisting the poles themselves does not release the locking mechanism, but rather the collet must be twisted to release the poles. Because it is far more unlikely that the collet will be inadvertently rotated, the present invention is more secure and reliable than the prior art.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 5 is a cut-away side view of the assembly of the present invention illustrating the open configuration;

FIG. 6 is a cut-away side view of the assembly of the present invention illustrating the locked configuration;

FIG. 9 is a view of a tree trimming tool of the present invention.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to telescoping pole assemblies.

Figure 1:
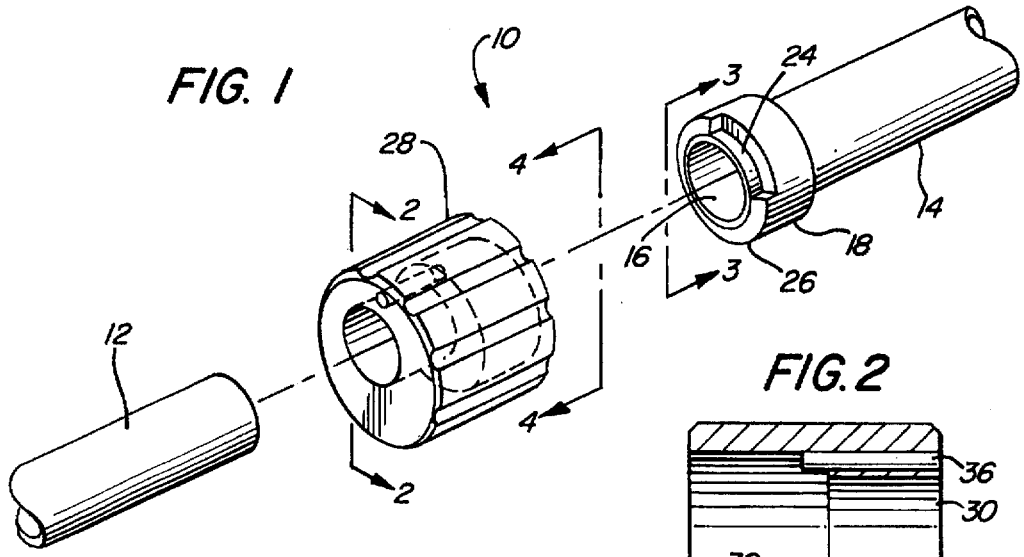
FIG. 1 is an exploded view of the telescoping pole assembly of the present invention showing the inner and outer poles, the annular collar, and the collet.

The present invention is directed to a telescoping pole assembly and a tree trimming tool using a telescoping pole assembly of the present invention. A special collet is used to secure the telescoping poles at any extended position by means of offset circular griping surfaces and an attached eccentric collar. The present invention is especially useful for locking fiberglass or plastic poles that tend to slip or crack and splinter with a typical concentric collet and, unlike the prior art, resists unlocking when a torque is applied to the pole assembly. The assembly 10 of the present invention is illustrated generally in FIG. 1. Inner pole 12 and outer pole 14 may be of a fiberglass or plastic construction, or they may be metal. The two poles are sized to the specific application with the outer diameter of the inner pole 12 sized to slide freely within the outer pole 14. Although shown in the figures as a hollow pole, the inner pole 12 of the present invention may be solid without loss of utility due to the nature of the locking force discussed more fully below. This allows the inner pole 12 to be made of lighter material if necessary because it may be solid.

Near or at the end 16 of the outer pole 14 is an annular collar 18 that is fixed about the outer pole by pressfit or adhesive, or any other practical means of firmly securing the annular collar 18 to the outer pole 14. The annular collar 18 is preferably made of aluminum due to its strength and machinability and possesses circular inner 20 and outer 22 diameters that are offset to yield an eccentric collar 18 (see FIG. 3). For most applications, a collar of approximately one inch in axial length is used, although this length is for convenience and is identified for illustration purposes only, and an inner diameter sized to receive the outer pole 14 securely. For an outer pole diameter of 1 ¼-inches, a typical annular collar will have an outer diameter of 1 ⅝-inches with an offset of 1/16-inch, yielding a maximum annular collar thickness of ¼-inch and a minimum thickness of ⅛-inch. With the offset of the two diameters, the thickness of the annular collar 18 gradually increases from a minimum thickness 38 to a maximum thickness 40 and back to the minimum thickness 38. The annular collar 18 further comprises a slot 24 along the end 26 of the collar 18. The slot 24 has a typical width of ⅛-inch and a length of approximately 60 to 80 degrees of circumference along the collar 18.

Figure 2:
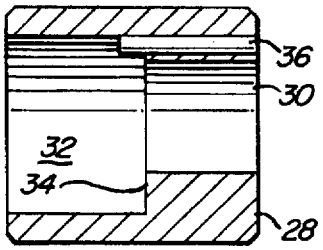
FIG. 2 is a cross-sectional view of the collet of the present invention illustrating the inner shoulder defined by the axial hole and the cylindrical cavity.

The collet 28 mounts over the end of the outer pole 14 at the collar 18, with the inner pole 12 sliding through an axial cylindrical hole 30 and into the outer pole 14. As illustrated in FIG. 2, the collet 28 has a cylindrical axial cavity 32 sized to receive the outer pole 14 with mounted annular collar 18 fixed thereon. The cylindrical cavity 32 extends into the collet 28 and is eccentric with the axial hole 30, and the interface or juncture of the axial hole 30 and the axial cavity 32 forms an inner shoulder 34 within the collet 28. Typically, the axial hole 30 will be bored through the collet 28, and then the collet will be inverted and the axial cylindrical cavity 32 will be counterbored into the collet but not through (see FIG. 2). Notch pin 36 protrudes from the inner shoulder 34 approximately 1/16- to 1/8-inch and cooperates with the slot 24 on the collar 18 to limit the rotation of the collet 28 about the collar 18.

Figure 7:
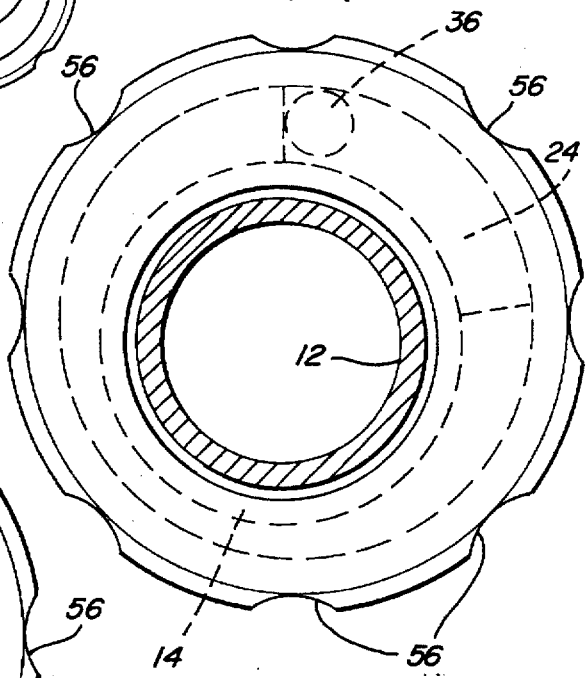
FIG. 7 is a cross-sectional view, partially in phantom, of the view looking into the collet with the annular collar and outer pole in place, rotated in the open configuration.
Figure 8:
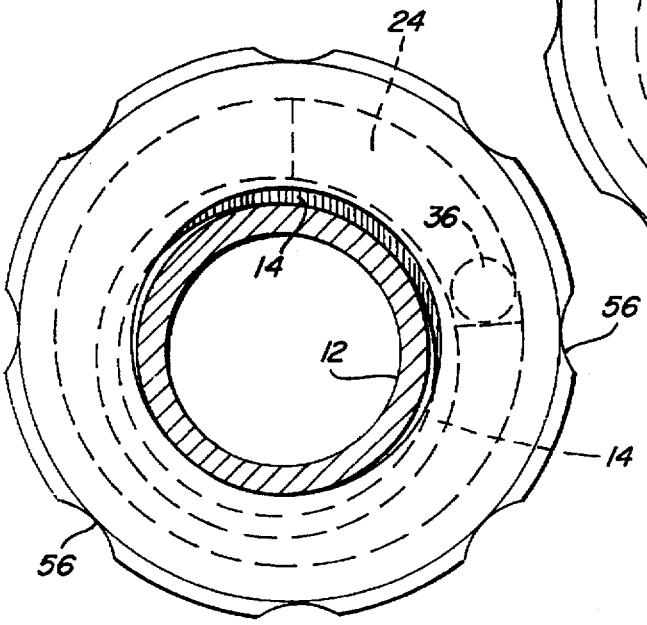
FIG. 8 is a cross-sectional view, partially in phantom, of the view looking into the collet with the annular collar and outer pole in place, rotated in the locked configuration.

The collet 28 is designed such that the cylindrical axial cavity 32 receives the outer pole 14 with the mounted collar 18 bearing against the inner shoulder 34. With the collet 28 rotated in the "open" position, the path through the collet 28 and into the outer pole 14 (see FIG. 5) is wider than the diameter of the inner pole 12, thereby allowing the inner pole 12 to slide freely through the collet 28 and into and out of the outer pole 14. In other words, the common cross-sectional area of the collet 28 and the outer pole 14, shown generally in FIGS. 7 and 8, is at a maximum when the collet is rotated in the open position (FIG. 7) and this alignment allows the inner pole to slide freely along this path. The notch pin 36 moves within the slot 24 when the annular collar 18 bears against the inner shoulder 34, and the length of the slot 24 defines the range of rotation allowable for the collet 28. The slot 24 is positioned to permit rotation of the collet 28 from an open configuration to a locked configuration, and the presence of the notch pin 36 and slot 24 facilitates the use of the assembly by defining the relative positions of the collet 28 and the collar 18 for the two configurations.

Figure 3:
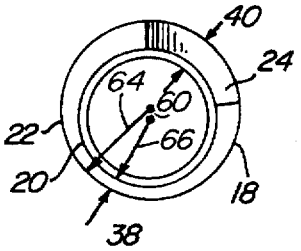
FIG. 3 is an axial view of the annular collar fixed on the outer pole.
Figure 4:
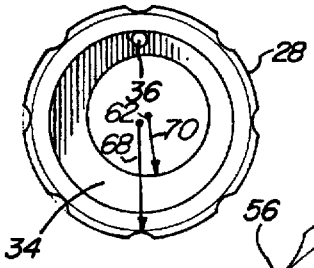
FIG. 4 is an axial view of the collet looking into the cavity for receiving the annular collar and outer pole.

The eccentricities of the collar 18 and the collet 28 are illustrated in FIGS. 3 and 4. Radii 64 and 66 of the collar 18 corresponding to the outer and inner radii, respectively, are offset at the center by eccentricity 60. Similarly, radii 68 and 70 of the collet 28 corresponding to the outer radius and the axial hole are offset at the center by eccentricity 62.

In a preferred embodiment, graphics may be added to the outer pole just below the collet to indicate the proper alignment of the collet in the open and closed configuration (not shown). In an alternative embodiment, the assembly can operate without the notch pin and slot without loss of the general inventive principles of the present invention. Without the notch pin 36, the collet 28 rotates freely about the outer pole 14 when the inner pole is not in place, but when the inner pole is inserted then the inner pole will only slide within the apparatus when the collet is rotated to the open configuration.

When the collet 28 is rotated away from the open position corresponding to the maximum cross-sectional area common to the axial hole 30 of the collet 28 and the inner diameter of the outer pole 14, the resulting misalignment of the collar 18 and the axial hole 30 of the collet 28 due to their eccentricities causes the path for the inner pole 12 to narrow (see, FIG. 8). The narrowing of the path eventually cinches the inner pole 12 between the collet 28 and the outer pole 14, causing the inner pole 12 to be frictionally locked in position (see FIG. 8). This locking force is the result of the resilient pressure deformation of the collet as it deforms about the inner pole when the rotation induces the misalignment. Furthermore, a torque applied to the poles does not unlock the lateral force applied by the collet 28 and, therefore, the locking mechanism of the present invention is not as susceptible to inadvertent unlocking as the prior art. In another preferred embodiment, a snap ring 42 is provided to retain the collet 28 in place over the annular collar 18. The snap ring 42 is placed inside the collet 28 and snaps into annular snap ring groove 44, where it preferably remains unless the assembly requires maintenance.

The specifics of manufacturing the present invention shall now be disclosed. The annular collar is preferably machined from heat treated 386 aluminum castings and cut to a length of one inch. A lathe is used to machine the annular collar's inner diameter to a diameter of approximately 0.008 less than the outer diameter of the outer pole in order to press fit the collar onto the pole, although other means of securing the collar to the outer pole are available and not critical to the invention. The center of the inner diameter is offset from the center of the outer diameter by approximately 1/16-inch to produce a variation in thickness of the collar from 1/8- to 1/4-inch around the circumference. The inner and outer surfaces of the collar are machined to a fine finish and the ends of the collar are smoothed to eliminate any rough surface.

The collet is machined from ABS plastic in the preferred embodiment, although it can be made from any suitable plastic or a metal. Grooves 56 are preferably cut longitudinally along the outside of the collet to provide a gripping surface for manual twisting. The axial hole 30 is bored through the collet 28 at a tolerance of approximately 0.03-inch from the outer diameter of the inner pole 12 to provide adequate clearance in the open configuration. The axial hole 30 is offset from the outer diameter of the collet by approximately the same distance as the collar, i.e., 1/16-inch. The collet is then reversed and the cylindrical cavity is counterbored to a diameter of the annular collar plus 0.03-inch to once again provide clearance and to permit free rotation of the collet about the collar when the inner pole is not present. The snap ring groove of depth 0.05-inch is then cut while the collet is on the lathe where the bottom of the collar would extend. The notch pin hole is drilled at the inner shoulder and the notch pin is mounted into the hole. Collet 28 is placed over the collar 18 after the collar is placed on the outer pole, then the snap ring is placed in the collet to keep the collet in place.

An important application of the present invention is an improved tree trimming device embodying the telescoping poles and locking mechanism of the present invention. The present invention allows the use of fiberglass poles instead of metal poles, which is safer when electrical power lines are present and generally more practical for cost concerns. The other important feature of the present invention which makes it especially suitable for tree trimming devices is the ability to twist and torque the tree trimming tool as needed in order to cut the branches or withdraw the tool from a snagged collection of branches. A tree trimming tool of the present invention is illustrated generally in FIG. 9. While the specifics of the cutting tool is not indicative of the inventive aspect of the present invention, the use of the telescoping pole is especially conducive to tree trimming tools as pictured comprising a base pole 46 with an extension pole 48 disposed therein. A cutting blade 50 is mounted on a first end 58 while a second end 54 remains inside said base pole 46. An eccentric annular collar 18 and cooperating collet 28 as recited above are adapted to rigidly secure the extension pole 48 within the base pole 46 by rotating the collet about the collar such that the resulting misalignment locks the extension pole in place.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. In an improved saw for use in tree-trimming applications having a cutting blade disposed on an elongated upper pole and an elongated lower pole cooperating with said elongated upper pole to receive said upper pole in a telescoping relationship, said improvement comprising:

a locking mechanism for locking and releasing of said upper pole within said lower pole which resists premature unlocking when a torque is applied to said upper pole, said locking mechanism comprising:

an annular collar fixed on said lower pole at a first end where said lower pole receives said upper pole, a thickness of said annular collar gradually varying along its circumference from a maximum thickness to a minimum thickness and back to the maximum thickness;

a hollow cylindrical collet rotatably disposed over said lower pole on said collar, said upper pole disposed axially therethrough, said collet having an inner radial shoulder defined by a smaller cylindrical cavity sized to receive said upper pole, and extending completely through said collet, and a larger cylindrical cavity sized to receive said lower pole and extending partially through said collet, said larger cylindrical cavity aligned eccentric with said smaller cylindrical cavity, such that when the collet is rotated about said annular collar, the variation in the thickness of said collar and the eccentricity of the smaller cylindrical cavity cause the collet to press against the upper pole to frictionally lock said upper pole with respect to said lower pole.

2. The improved saw as recited in claim 1 wherein said annular collar further comprising a slot at said first end, said slot beginning approximately at said maximum thickness and extending circumferentially therefrom, and a pin extending from said inner radial shoulder of said hollow cylindrical collet and having an exposed length less than a depth of said slot, whereby the pin engages the slot when the collet is disposed over said lower pole and said collar such that the rotation of the collet about said annular collar is limited to the arc defined by said slot with said pin therein, said slot defining an open position and a locked position.

3. A telescoping pole assembly comprising:

a hollow cylindrical first pole having an outer diameter and an inner diameter;

a cylindrical second pole having an outer diameter smaller than the inner diameter of said hollow cylindrical first pole, said second pole at least partly disposed within said first pole at a first end and cooperating with said first pole in a sliding relationship;

an annular collar mounted on said first pole at said first end, said annular collar having an outer diameter eccentric with said first pole; and a cylindrical collet having a cylindrical cavity extending axially into said collet and sized to receive said hollow cylindrical first pole with mounted collar, and further having an axial hole extending axially therethrough said collet, said axial hole sized to receive said second pole therethrough and eccentric with said cylindrical cavity, said collet further comprising an interior shoulder defined by said cylindrical cavity and said axial hole, said cylindrical collet receiving said first pole in said cylindrical cavity with said annular collar bearing against said interior shoulder, said second pole disposed within said collet in said axial hole and extending into said second pole, whereby a rotation of the collet about the annular collar causes a misalignment of the axial hole and an inner diameter of said second pole, said misalignment causing said collet to transmit a lateral locking force on said second pole.

4. A telescoping pole assembly for locking and releasing an extension pole comprising:

a first hollow pole having an inner and an outer diameters;

an annular collar adapted to fit over said first hollow pole at a first end and fixed thereon, a thickness of said annular collar gradually varying along its circumference from a maximum value to a minimum value and back to the maximum value;

a cylindrical collet rotatably disposed on said collar having a first axial bore therethrough, said first axial bore eccentric with a centerline of said cylindrical collet, and a second axial counterbore sized to receive said first hollow pole and said annular collar and terminating in said cylindrical collet to define a shoulder thereat, said first end of said first hollow pole and said annular collar disposed within said counterbore; and a second pole having a diameter less than the inner diameter of said first pole and less than the first axial bore of said cylindrical collet whereby said second pole slides freely along a path defined by said inner diameter of said first hollow pole and said first axial bore of said cylindrical collet when said cylindrical collet is rotated about said annular collar to a maximum common cross-sectional area, and said second pole is frictionally locked within said assembly when said cylindrical collet is rotated away from said maximum common cross-sectional area.

5. A locking mechanism for a telescoping pole assembly having an inner pole slidably extending from an outer pole, said mechanism comprising:

a collar adapted to be mounted on said outer pole and having an outer diameter eccentric with said outer pole;

a hollow collet rotatably mounted on said collar and having an inner diameter sized for receiving said inner pole thereinthrough whereby said inner pole can slide within said hollow collet when said collet is rotated to a maximum aligned pathway with said outer pole, and said inner pole can be frictionally inhibited from sliding when said collet is rotated to an aligned pathway having a width less than an outer diameter of said inner pole; and a snap ring disposed within said collet for fixing said outer pole within said collet.

6. A locking mechanism as recited in claim 5 further comprising a notch pin disposed within said collet, and a slot in said collar, such that said notch pin cooperates with said slot to limit the range of rotation of said collet about said collar.

* * * * *